US012025306B1

(12) United States Patent
Han et al.

(10) Patent No.: US 12,025,306 B1
(45) Date of Patent: Jul. 2, 2024

(54) METHODS AND SYSTEMS TO DETECT FLAMEHOLDING IN TURBINE ASSEMBLIES

(71) Applicant: General Electric Company, Schenectady, NY (US)

(72) Inventors: Fei Han, Clifton Park, NY (US); Michael J. Hughes, State College, PA (US); Nicholas Arthur Magina, Saratoga Springs, NY (US); Timothy A. Healy, Greenville, SC (US)

(73) Assignee: GE INFRASTRUCTURE TECHNOLOGY LLC, Greenville, SC (US)

( * ) Notice: Subject to any disclaimer, the term of this patent is extended or adjusted under 35 U.S.C. 154(b) by 0 days.

(21) Appl. No.: 18/066,554

(22) Filed: Dec. 15, 2022

(51) Int. Cl.

| | |
|---|---|
| ***F23D 14/76*** | (2006.01) |
| ***F23D 14/82*** | (2006.01) |
| ***F23N 1/00*** | (2006.01) |
| ***F23R 3/36*** | (2006.01) |

(52) U.S. Cl.
CPC ..... *F23D 14/76* (2013.01); *F23N 1/005* (2013.01); *F23R 3/36* (2013.01); *F23D 14/825* (2013.01); *F23D 2205/00* (2013.01); *F23D 2208/10* (2013.01); *F23D 2210/00* (2013.01)

(58) Field of Classification Search
CPC .. F23N 2231/28; F23N 2241/20; F23N 1/002; F23R 3/26; F23R 3/346; F23D 14/82; F23D 2209/10; F02C 9/16; F02C 9/50
See application file for complete search history.

(56) References Cited

U.S. PATENT DOCUMENTS

| | | | | |
|---|---|---|---|---|
| 6,357,216 | B1 * | 3/2002 | Scott | F02C 9/50 60/39.23 |
| 8,752,362 | B2 * | 6/2014 | Kraemer | F23N 1/002 60/779 |
| 10,024,532 | B2 * | 7/2018 | Kimura | F23R 3/346 |
| 2010/0280732 | A1 * | 11/2010 | Singh | F23N 5/082 701/100 |

* cited by examiner

*Primary Examiner* — Anthony Ayala Delgado
(74) *Attorney, Agent, or Firm* — Armstrong Teasdale LLP

(57) ABSTRACT

A method for detecting flameholding in at least one combustor of a turbine engine includes measuring dynamic pressure data of the at least one combustor of the turbine engine; converting the dynamic pressure data to frequency-domain spectral energy amplitudes for the dynamic pressure data; and comparing the spectral energy amplitudes against a dynamic amplitude threshold value to determine whether the amplitudes exceed the threshold minimum amplitude value, wherein exceeding the dynamic amplitude threshold indicates a flameholding occurrence.

20 Claims, 8 Drawing Sheets

METHODS AND SYSTEMS TO DETECT FLAMEHOLDING IN TURBINE ASSEMBLIES

BACKGROUND

This disclosure relates generally to turbine engine assemblies and, more particularly, to methods and systems to detect flameholding in turbine engine assemblies during turbine operation.

At least some known turbine engines are used to generate power in cogeneration facilities and power plants. Such engines may have high specific work and power per unit mass flow requirements. One requirement for power-generating gas turbines is related to the emissions they produce (typically, nitrous oxides and carbon dioxide). These emissions may result from incomplete combustion of a hydrocarbon fuel, such as natural gas. Premixing of the fuel and air prior to combustion, such as within a fuel nozzle or fuel injector, can contribute to more complete burning and to lower emissions.

To further reduce greenhouse gas emissions, at least some known turbine engines, such as gas turbine engines, include fuel nozzles that operate with increased hydrogen gas concentration in the fuel mixture. Normal operation of these fuel nozzles requires that a flame be prevented from forming within the fuel nozzles themselves. Hydrogen is a more volatile fuel than natural gas and produces flames with a greater velocity than those produced using only natural gas. As a result, a hydrogen flame may inadvertently form in the fuel nozzles due to momentary upset conditions owing, e.g., to a sudden transient in the gas turbine or a momentary change in fuel supply conditions.

Typically, the fuel nozzles are not designed to endure the high temperatures of ignited combustion gases produced in the combustion chamber. Under certain unintentional conditions, the operation of the combustor using fuel with a high concentration of hydrogen can cause the flame to "flashback" from the combustion zone into the fuel nozzles where the flame may continue to burn—a condition referred to as "flameholding." Another problem that can lead to flameholding is the increase in the hydrogen concentration within the fuel mixture, when compared to a conventional fuel supply that is solely or predominantly natural gas (e.g., methane). The presence of hydrogen at high concentrations in the fuel supply promotes flame speeds that are higher than natural gas and creates an environment where flashback is more possible and flameholding is more difficult to extinguish. Flashback and flameholding can each damage the fuel nozzle, create hot streaks that exceed the local maximum operating temperature of the turbine components, and cause the turbines to mechanically fail or to stall. Moreover, exceeding flameholding margins may also limit the useful life of the fuel nozzles and/or may cause damage to the surrounding combustor liner.

Thus, to enable operating gas turbines at higher hydrogen concentration, there is a need to compensate for an increased risk of flameholding. More specifically, there is a need to accurately detect and monitor flameholding events and conditions during operation and to mitigate such conditions in real-time to facilitate reducing the likelihood that the gas turbine will stall, fail, or incur hardware damage.

SUMMARY

In one embodiment, a method for detecting flameholding in a turbine engine is provided. The method includes measuring dynamic pressure within the at least one combustor of the turbine engine, converting dynamic pressure data to frequency-domain spectral energy amplitudes associated with the dynamic pressure data and, comparing the frequency-domain spectral energy amplitudes against a dynamic amplitude threshold value to determine whether the spectral energy amplitudes exceed the dynamic amplitude threshold value, wherein those spectral energy amplitudes exceeding the dynamic amplitude threshold value indicate a flameholding occurrence.

In another exemplary embodiment, a method of operating a turbine engine at an increased hydrogen concentration is provided. The method includes supplying a fuel mixture having a second hydrogen gas concentration to at least one combustor of the turbine engine. The second hydrogen gas concentration defines a broadened flameholding margin window of the turbine engine, the broadened flameholding margin window resulting in the reduced emissions and reduced audible noise of the turbine engine. The method further includes measuring dynamic pressure data within at least one combustor of the turbine engine, converting the dynamic pressure data to frequency-domain spectral energy amplitudes associated with the dynamic pressure data, and comparing the spectral energy amplitudes against a dynamic amplitude threshold value to determine whether the spectral energy amplitudes exceed the dynamic amplitude threshold value. The spectral energy amplitudes exceeding the dynamic amplitude threshold value indicate a flameholding occurrence. The method further includes mitigating flameholding conditions of the at least one combustor by adjusting the hydrogen gas concentration of the fuel mixture supplied to the at least one combustor from the second hydrogen gas concentration to a first hydrogen gas concentration. The second hydrogen gas concentration is higher than the first hydrogen gas concentration, and the first hydrogen gas concentration defines a standard operating window.

In another exemplary embodiment, a system to facilitate operating at least one combustor of a turbine engine within flameholding margins is provided. The system includes a fuel injection system coupled in flow communication with a blended fuel supply for supplying a fuel mixture into at least one fuel injector within the at least one combustor of the turbine engine. The fuel mixture has a hydrogen gas concentration adjustable from a first hydrogen gas concentration to a second hydrogen gas concentration, the second hydrogen gas concentration being higher than the first hydrogen gas concentration. The system further includes a detection system including a processor and a plurality of dynamic pressure sensors. The processor is programmed to supply the fuel mixture with the second hydrogen gas concentration to the turbine engine. The second hydrogen gas concentration defines a broadened flameholding margin window of the turbine engine, and the broadened flameholding margin window enables the turbine engine to operate at higher mechanical power output, reduced emissions, and reduced audible noise relative to the turbine engine operating at the first hydrogen gas concentration. The processor is further programmed to receive, from one or more of the plurality of dynamic pressure sensors, dynamic pressure data measured within the at least one combustor of the turbine engine and to convert the dynamic pressure data to frequency-domain spectral energy amplitudes associated with the dynamic pressure data. The processor is further programmed to compare the spectral energy amplitudes against a dynamic amplitude threshold to determine whether the spectral energy amplitudes exceed the dynamic amplitude threshold. Spectral energy amplitudes exceeding the dynamic amplitude threshold indicate a flameholding occurrence. The processor is further programmed to decrease the hydrogen gas concentration of the fuel mixture from the second hydrogen gas concentration to the first hydrogen gas concentration. The first hydrogen gas concentration defines a standard operating window that has a reduced likelihood of flameholding as compared to the broadened flameholding margin window

DETAILED DESCRIPTION

The exemplary methods, apparatus, and systems described herein overcome at least some known disadvantages associated with at least some known combustion systems of turbine engines by monitoring and detecting a flameholding or flameholding conditions in real time and during normal operations of the turbine engine. By monitoring flameholding or flameholding conditions in real time, the turbine engine can operate on fuels at a higher hydrogen concentration.

As used herein, the terms "flameholding", "flameholding event" and "flameholding occurrence" shall denote a condition in which operation of the combustor using fuel with a high concentration of hydrogen can cause the flame to "flashback" from the combustion zone into the fuel nozzles where the flame may continue to burn. For the purposes of this disclosure, flameholding occurs within the combustion zone or at the combustors.

The embodiments described herein provide a flameholding detection system for use with gas turbine engines and a method of detecting flameholding during operation of the turbine engine. The system and methods described herein can also be configured to mitigate flameholding conditions (by way of example, reducing the hydrogen gas concentration in a fuel mixture being injected into the gas turbine engine). It should also be appreciated that the term "fluid" as used herein includes any medium or material that flows, including, but not limited to, gaseous fuel and air.

Figure 1:
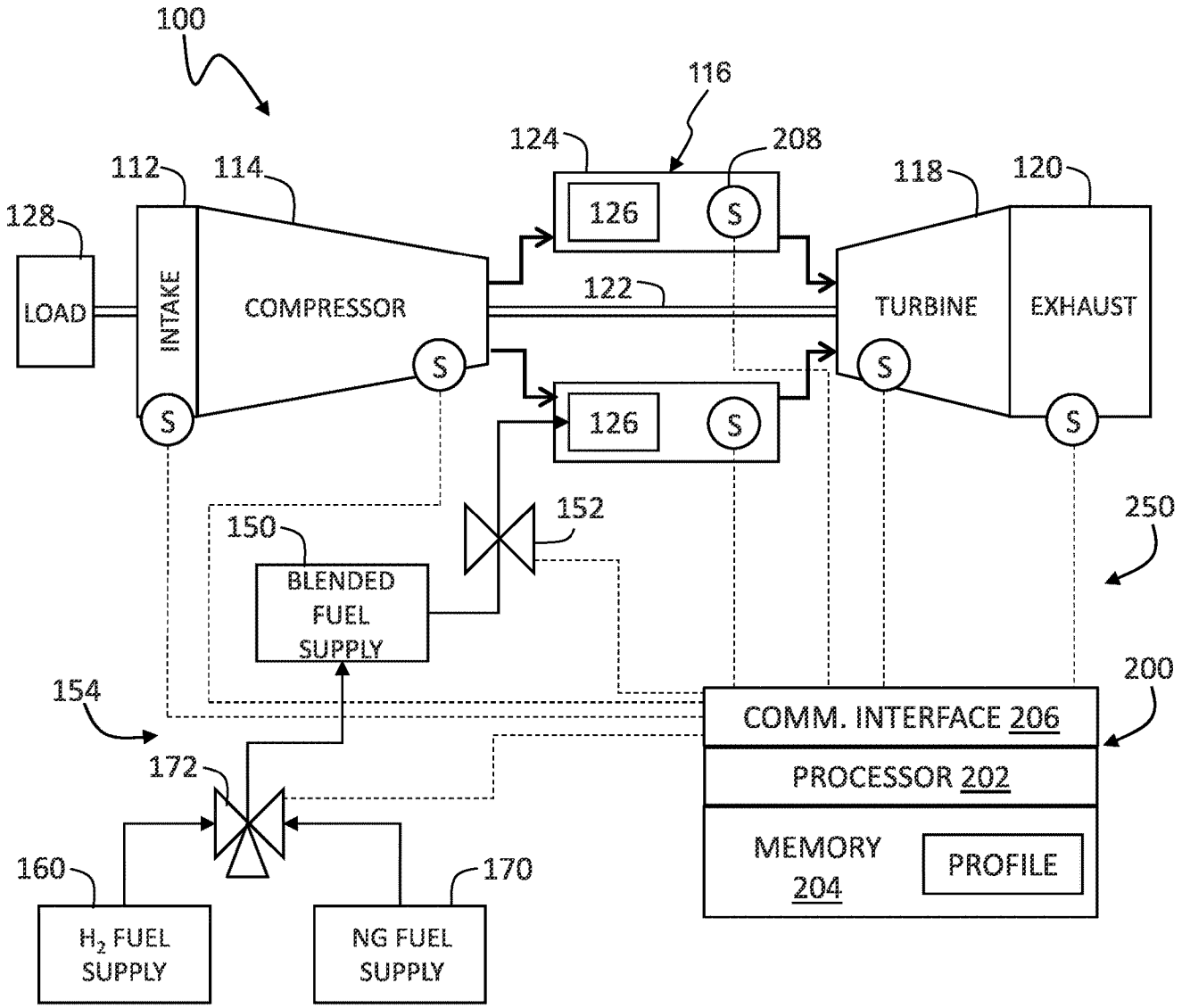
FIG. 1 is a schematic cross-sectional view of an exemplary turbine engine.

FIG. 1 is a schematic cross-sectional view of an exemplary turbine engine 10. More specifically, turbine engine 100 is a gas turbine engine. While the exemplary embodiment is illustrated in association with a gas turbine engine, the present disclosure is not limited to any one particular engine, and one of ordinary skill in the art will appreciate that the current system and method may be used in connection with other turbine engines. As used herein, the terms "turbine," "turbine assembly," and "turbine engine" shall be used interchangeably.

In the exemplary embodiment, turbine engine 100 includes an intake section 112, a compressor section 114 coupled downstream from intake section 112, a combustor section 116 coupled downstream from compressor section 114, a turbine section 118 coupled downstream from combustor section 116, and an exhaust section 120. Turbine section 118 is coupled to compressor section 114 via a rotor shaft 122. In the exemplary embodiment, combustor section 116 includes a plurality of combustors 124 (e.g., "n" combustor cans disposed in an annular array about the rotor shaft 122, where n is typically, but not exclusively, 8, 10, 12, or 16 combustors 124). Combustor section 116 is coupled to compressor section 114 such that each combustor 124 is positioned in flow communication with the compressor section 114. A fuel injector 126 is coupled to each combustor 124. Turbine section 118 is coupled to compressor section 114 and to a load 128 such as, but not limited to, an electrical generator and/or a mechanical drive application. In the exemplary embodiment, each compressor section 114 and turbine section 118 include at least one rotor disk assembly that is coupled to a rotor shaft 122 to form a rotor assembly.

During operation, intake section 112 channels air towards compressor section 114 wherein the air is compressed to a higher pressure and temperature before being discharged towards combustor section 116. Within each combustor 124, the compressed air is mixed with fuel or a fuel mixture and ignited to generate combustion gases that are channeled towards turbine section 118. More specifically, in combustors 124, fuel mixture (for example, natural gas and hydrogen) is injected into the air flow, and the fuel-air mixture is ignited to generate high temperature combustion gases that are channeled towards turbine section 118. Turbine section 118 converts the thermal energy from the gas stream to mechanical rotational energy, as the combustion gases impart rotational energy to turbine section 118 and to rotor assembly 132. The mechanical rotational energy drives the rotor shaft 122 and the generator 128, which is coupled to the rotor shaft 122, to produce electricity.

The fuel injectors 126 are coupled in flow communication with a blended fuel supply 150 as part of a fuel injection system 154. The fuel injection system 154 includes a hydrogen fuel supply 160 and a natural gas (e.g., methane) fuel supply 170; a mixing valve 172 (e.g., a three-way valve) in fluid communication with the hydrogen fuel supply 160 and the natural gas supply 170; a blended fuel supply 150 receiving a mixture of fuels from the mixing valve 172; and a plurality of fuel distribution valves 152 (only one of which is illustrated for clarity) for directing the fuel mixture to the fuel injectors 126 of each combustor 124. The mixing valve 172 is in communication with the controller 200 to adjust the ratio of hydrogen to natural gas, thereby producing a blended fuel at blended fuel supply 150 with a desired hydrogen gas concentration.

Fuel from the hydrogen fuel supply 160 and the natural gas fuel supply 170 are metered, via the mixing valve 172 coupled to controller 200, to enable desired hydrogen concentrations of the fuel mixture to be supplied to the blended fuel supply 150. The hydrogen gas concentration within the blended fuel supply 150 ranges from a first hydrogen gas concentration to a second hydrogen gas concentration, where the first hydrogen gas concentration is greater than zero (that is, some hydrogen gas is blended with the natural gas) and where the second hydrogen gas concentration is greater than the first hydrogen gas concentration. In some embodiments, fuel injection system 154, in response to controller 200, can selectively adjust the hydrogen concentrations of the fuel mixture to any desired hydrogen concentration between the first hydrogen gas concentration and the second hydrogen gas concentration, including the first hydrogen gas concentration and the second hydrogen gas concentration. Operating the turbine engine 100 with the second hydrogen gas concentration leads to lower emissions of greenhouse gases of the turbine engine 100 relative to operating the turbine engine 100 with the first hydrogen gas concentration. However, at the second hydrogen gas concentration, the turbine engine 100 is generally more prone to flameholding due to the presence of the higher hydrogen gas concentrations, since hydrogen is highly reactive and diffusive and produces short flames with high velocity.

As used herein, the term "standard operating window" of the turbine engine 100 denotes an operating state of the turbine engine 100 in which the combustors 124 are operating with a fuel mixture having the first hydrogen gas concentration, and the term "broadened flameholding margin" or "broadened flameholding margin window" of the turbine engine 100 denotes an operating state of the turbine engine 100 in which the combustors are operating with a fuel mixture having the second hydrogen gas concentration. The blending valve 172 is adjusted, via signals from controller 200, to supply a fuel mixture with the desired hydrogen gas concentration to the blended fuel supply 150. A turbine engine 100 operating within the broadened flameholding margin window has greater mechanical power output, relative to a turbine engine 100 operating in the standard operating window, but the broadened flameholding margin window has an increased likelihood of a flameholding occurrence in the combustors 124.

Similar to the hydrogen gas concentration, in some embodiments, the blended fuel supply 150 can be metered to selectively adjust the fuel supply pressure or more generally fuel injector pressure ratio, where the fuel injector pressure ratio is defined as the fuel supply pressure divided by the combustor pressure. An increased fuel injector pressure ratio produces stronger combustion. It should be understood that the aforementioned parameters (such as, but not limited to, the hydrogen concentration in the fuel mixture, the fuel injector pressure ratio, the velocity of the fuel mixture, and/or the temperature of the fuel mixture) of the turbine engine 100 are set to normally operate in the standard operating window, which has a reduced likelihood of flameholding than the broadened operating window. The temperature of the fuel mixture is adjusted by a heat exchanger in communication with the controller 200 (of FIGS. 1 and 2). The heat exchanger can be positioned downstream from the blended fuel supply 150. The temperature of the fuel mixture is adjusted by increasing or decreasing operation of the heat exchanger.

To reduce emissions of the turbine engine 100, one or more of the aforementioned parameters are increased or adjusted such that the turbine engine 100 operates within the broadened flameholding margin window. It should be appreciated that flameholding margins are fuel specific and turbine engine specific.

Figure 2:
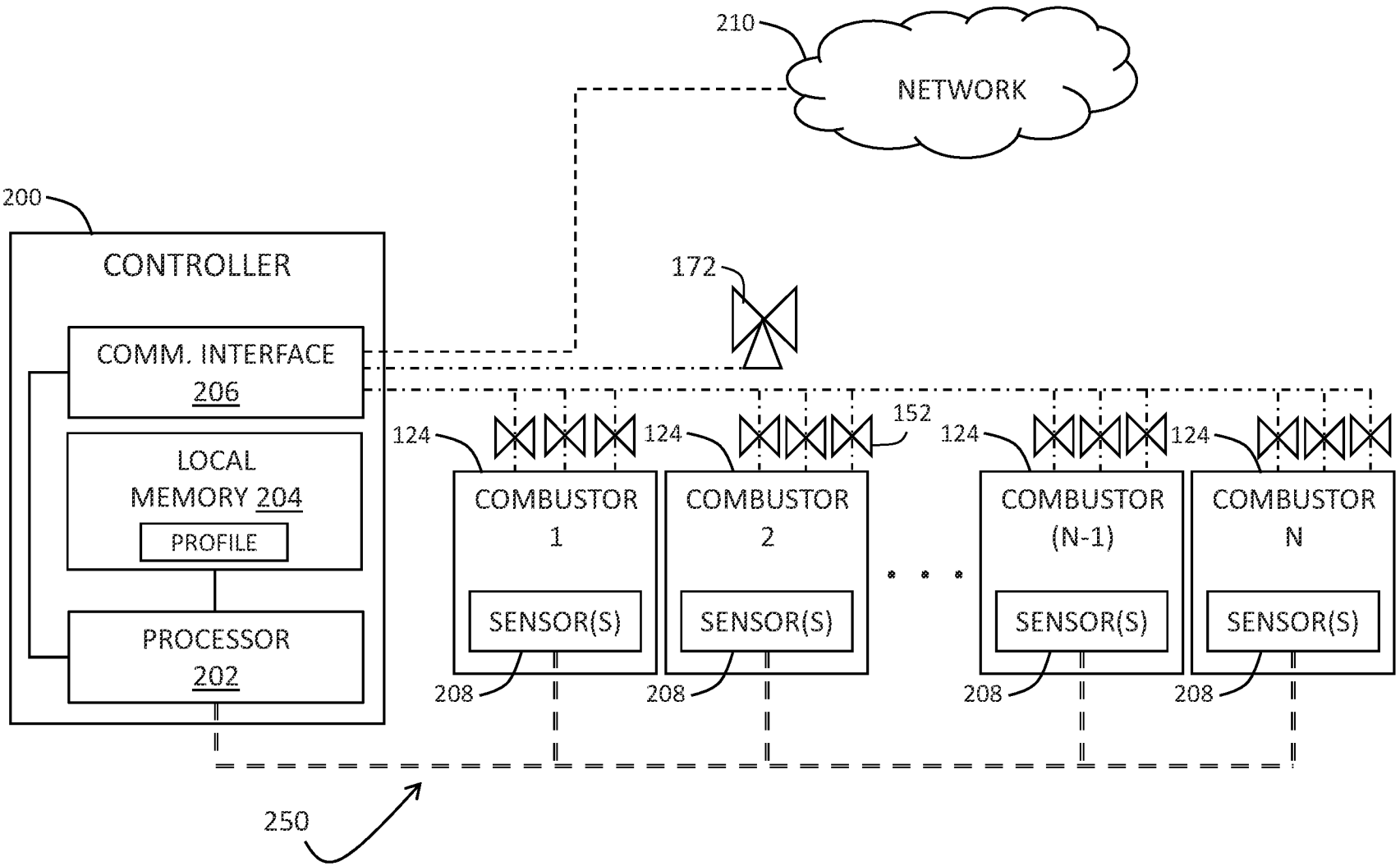
FIG. 2 is a schematic view of an exemplary detection system that may be used to detect flameholding occurrences within a combustor of a turbine engine, such as the turbine engine shown in FIG. 1.
Figure 7:
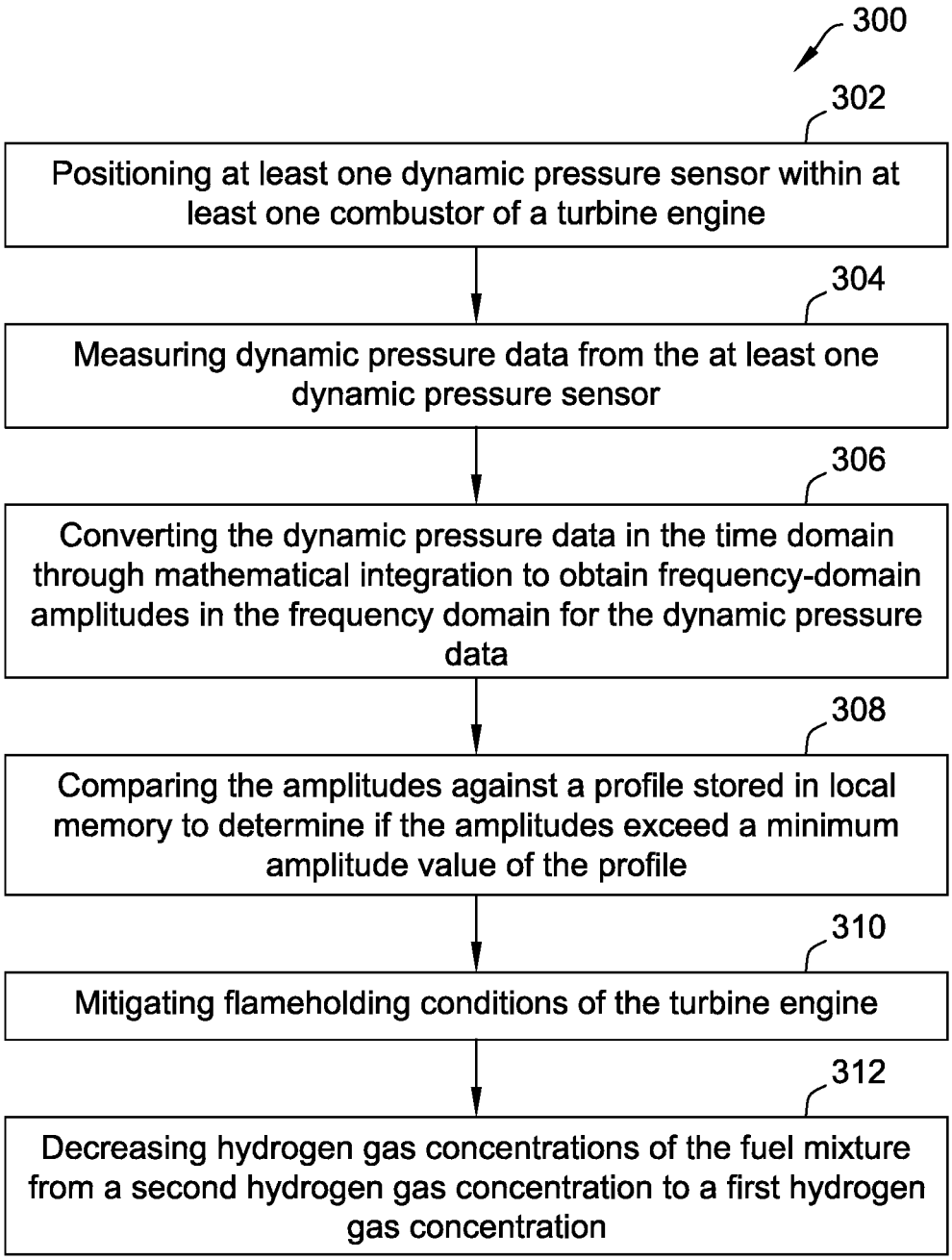
FIG. 7 illustrates a flowchart of an exemplary method for detecting and mitigating flameholding in a combustor of a turbine engine; and, FIG. 8 illustrates a flowchart of an exemplary method for operating a turbine engine with an increased power output, while mitigating flameholding risks.
Figure 8:
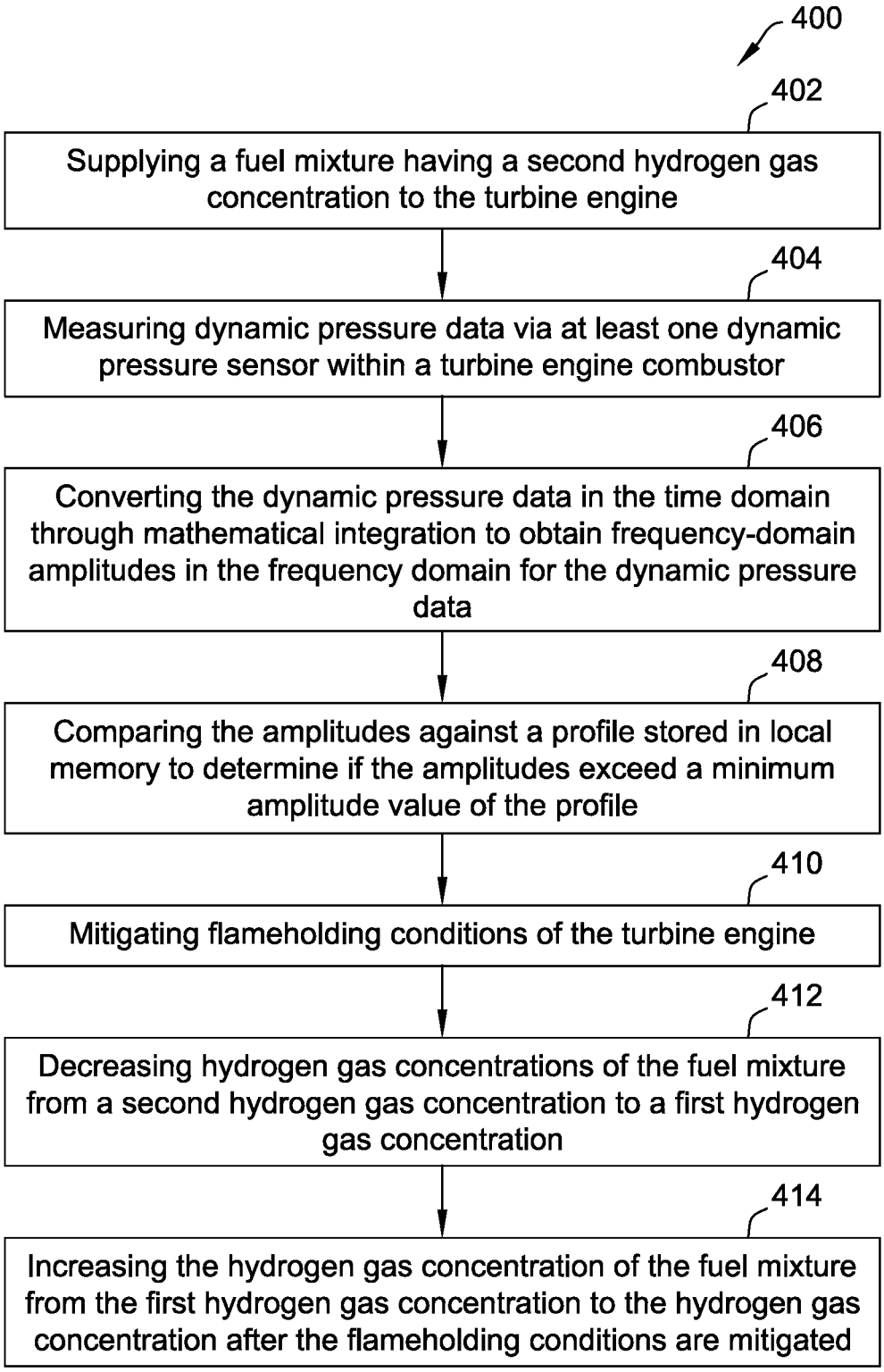

The detection system 250 illustrated in FIG. 2 and the exemplary methods illustrated in FIGS. 7 and 8 may be used to monitor and detect flameholding occurrences within the turbine engine 100 such that the turbine engine 100 can operate at a higher efficiency near or within flameholding margins. The detection system 250 includes the controller 200 and the sensors 208. In some embodiments, the detection system 250 can mitigate flameholding occurrences of the turbine engine 100 by selectively reducing the supply of the hydrogen gas concentration in the fuel mixture, for example, by reducing the supply of the hydrogen gas concentration from the second hydrogen gas concentration to the first hydrogen gas concentration, or to a desired hydrogen gas concentration between the first and second gas concentrations. One skilled in the art will appreciate that any of the aforementioned parameters can also, or in the alternative, be adjusted to cause the turbine engine 100 to change from operating within the broadened flameholding margin window to operating in the standard operating window, thus mitigating likelihood of flameholding when the detection system 250 detects flameholding in one of the combustors 124.

FIG. 2 illustrates an exemplary detection system 250 that includes a controller 200 that is communicatively connected to components of the turbine engine 100. The controller 200 includes a processor 202, a local memory 204, and a communications interface 206, and the detection system 250 further includes a plurality of sensors 208 in communication with the controller 200. Specifically, the plurality of sensors 208 are communicatively connected to the processor 202 (as shown by double dashed lines). In some embodiments, the communications interface 206 and the controller 200 are coupled to at least the fuel injectors 126, the intake section 112, and the blended fuel valve(s) 152, as shown in FIG. 1. In some embodiments, the communications interface 206 includes a programmable logic controller that controls at least the fuel injectors 126, the intake section 112, the mixing valve 172, and the blended fuel valve(s) 152. In some embodiments, the communications interface 206 is configured to selectively increase or decrease the hydrogen gas concentrations of the fuel mixture from the first hydrogen gas concentration to the second hydrogen gas concentration or to a desired value in-between by adjusting the mixing valve 172 to introduce a different amount of hydrogen gas.

To mitigate flameholding occurrences, it may be desirable in some instances to re-distribute the fuel mixture within the combustor 124 (e.g., among the various fuel injectors 126). Accordingly, as shown in FIG. 2, each combustor 124 may be provided with a plurality of blended fuel valves 152. Each of the blended fuel valves 152 for each combustor 124 may be in communication with the controller 200 for optimum control of the fuel mixture supplied to the fuel injectors 126 of each combustor 124. Although FIG. 2 illustrates each combustor 124 of the "n" number of combustor cans as having three fuel distribution valves 152, it should be understood that each combustor 124 may have fewer or more distribution valves 152.

The sensors 208 are positioned at various locations within the turbine engine 100 (indicated in FIG. 1 with the letter "S"). The sensors 208 are configured to measure at least dynamic pressure and temperature in a region local to where the sensors 208 are positioned. In some embodiments, the sensors 208 are dynamic pressure sensors. In some embodiments, the sensors 208 are temperature sensors. In some embodiments, the sensors 208 are thermocouples. In some embodiments, temperature sensors and/or dynamic pressure sensors 208 are positioned at one or more of the intake section 112, compressor section 114, combustor section 116, and turbine section 118. In some embodiments, the temperature sensors and/or dynamic pressure sensors 208 are positioned at the liner of the combustor or at the combustor head-end (e.g., in proximity to fuel injectors 126).

The processor 202 is configured for executing instructions. For example, executable instructions are stored in the memory 204, and the processor 202 may include one or more processing units (e.g., in a multi-core configuration). The one or more processing units suitably perform individual functions of the processor 202 and execute all or part of the instructions. The term processor, as used herein, refers to central processing units, microprocessors, microcontrollers, reduced instruction set circuits (RISC), application specific integrated circuits (ASIC), a programmable logic circuit (PLC), and any other circuit or processor capable of executing the functions described herein. The above are examples only and are thus not intended to limit in any way the definition and/or meaning of the term "processor."

The local memory 204 stores non-transitory, computer-readable instructions for performance of the techniques described herein. Such instructions, when executed by the processor 202, cause the processor 202 to perform at least a portion of the methods described herein. In some embodiments, the memory 204 stores computer-readable instructions for providing a user interface to the user via a media output component and for receiving and processing input from an input device. The memory 204 may include, but is not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). Although illustrated as separate from the processor 202, in some embodiments the memory 204 is combined with the processor 202, such as in a microcontroller or microprocessor, but may still be referred to separately. The above memory types are examples only and are thus not limiting as to the types of memory usable for storage of a computer program.

In some embodiments, the controller 200 includes, or is connected to, a communication interface 206, which is an input device for receiving input from the user. The input device is any device that permits the controller to receive analog and/or digital commands, instructions, or other inputs from the user, including visual, audio, touch, button presses, stylus taps, etc. The input device may include, for example, a variable resistor, an input dial, a keyboard/keypad, a pointing device, a mouse, a stylus, a touch sensitive panel (e.g., a touch pad or a touch screen), a gyroscope, an accelerometer, a position detector, an audio input device, or any combination thereof. A single component such as a touch screen may function as both an output device of the media output component and the input device.

The communication interface 206 enables the controller to communicate with remote devices and systems forming a network 210, such as remote sensors, remote databases, remote controllers, and the like, and may include more than one communication interface for interacting with more than one remote device or system. The communication interfaces 206 may be wired or wireless communication interfaces that permit the controller 200 to communicate with the remote devices and systems directly or via a network 210. Wireless communication interfaces may include a radio frequency (RF) transceiver, a Bluetooth® adapter, a Wi-Fi transceiver, a ZigBee® transceiver, a near field communication (NFC) transceiver, an infrared (IR) transceiver, and/or any other device and communication protocol for wireless communication. (Bluetooth is a registered trademark of Bluetooth Special Interest Group of Kirkland, Washington; ZigBee is a registered trademark of the ZigBee Alliance of San Ramon, California.) Wired communication interfaces may use any suitable wired communication protocol for direct communication including, without limitation, USB, RS232, I2C, SPI, analog, and proprietary I/O protocols. In some embodiments, the wired communication interfaces include a wired network adapter allowing the controller 200 to be coupled to a network, such as the Internet, a local area network (LAN), a wide area network (WAN), a mesh network, and/or any other network to communicate with remote devices and systems via the network 210.

Figure 3:
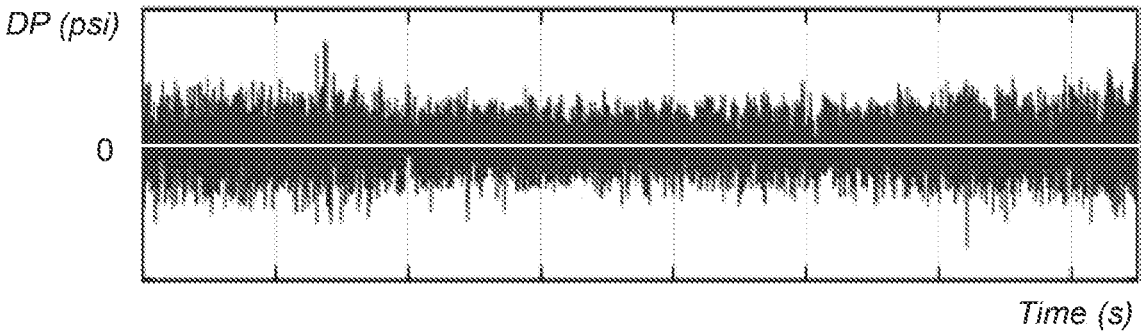
FIG. 3 illustrates an exemplary graph of dynamic pressure measurements over time.

FIG. 3 illustrates an exemplary graph of dynamic pressure DP measurements collected over time from at least one dynamic pressure sensor 208 within the combustor section 116. In some embodiments, the dynamic pressure is measured in pounds per square inch (PSI), and the time is measured in seconds. The dynamic pressure sensor 208 continuously measures dynamic pressure data DP and transmits dynamic pressure data to the controller 200, and more specifically to the processor 202. The dynamic pressure data DP is measured by the dynamic pressure sensors 208 in the time domain. The processor 202 in some embodiments stores the dynamic pressure data DP from the at least one dynamic pressure sensor 208 in memory 204. The processor 202 is configured to process the dynamic pressure data in the time domain through mathematical integration (an algorithm) to obtain output data in the frequency domain.

In some embodiments, the algorithm is a mathematical integration such as a Fourier Transform. In some embodiments, the algorithm is a fast Fourier transform (FFT). In some embodiments, the algorithm is a discrete Fourier transform. In some embodiments, the processor 202 utilizes conventional multi-paradigm programming languages and numeric computing generally. The algorithms convert time-domain data to frequency-domain amplitudes. Whereas a time-domain graph illustrates signal or data changes over time, a frequency-domain graph illustrates the amplitude of the data or signal within a given frequency band over a range of frequencies.

Figure 4A:
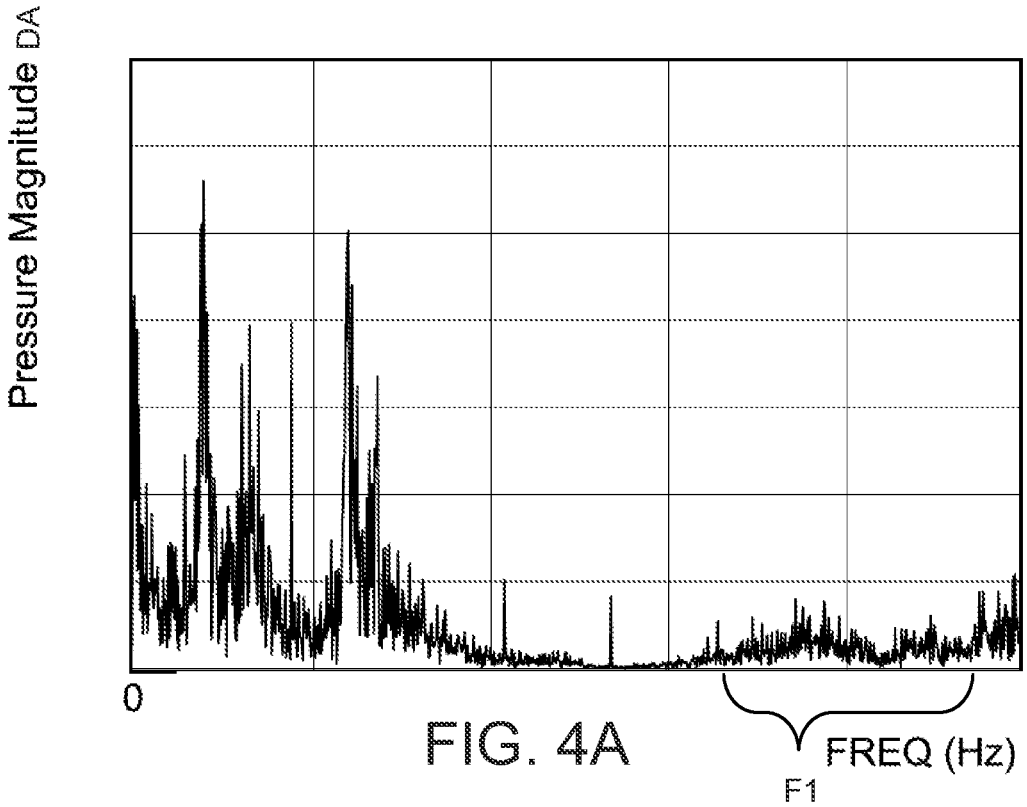
FIG. 4A illustrates an exemplary graph of dynamic pressure magnitudes over a frequency range during nominal operation.
Figure 4B:
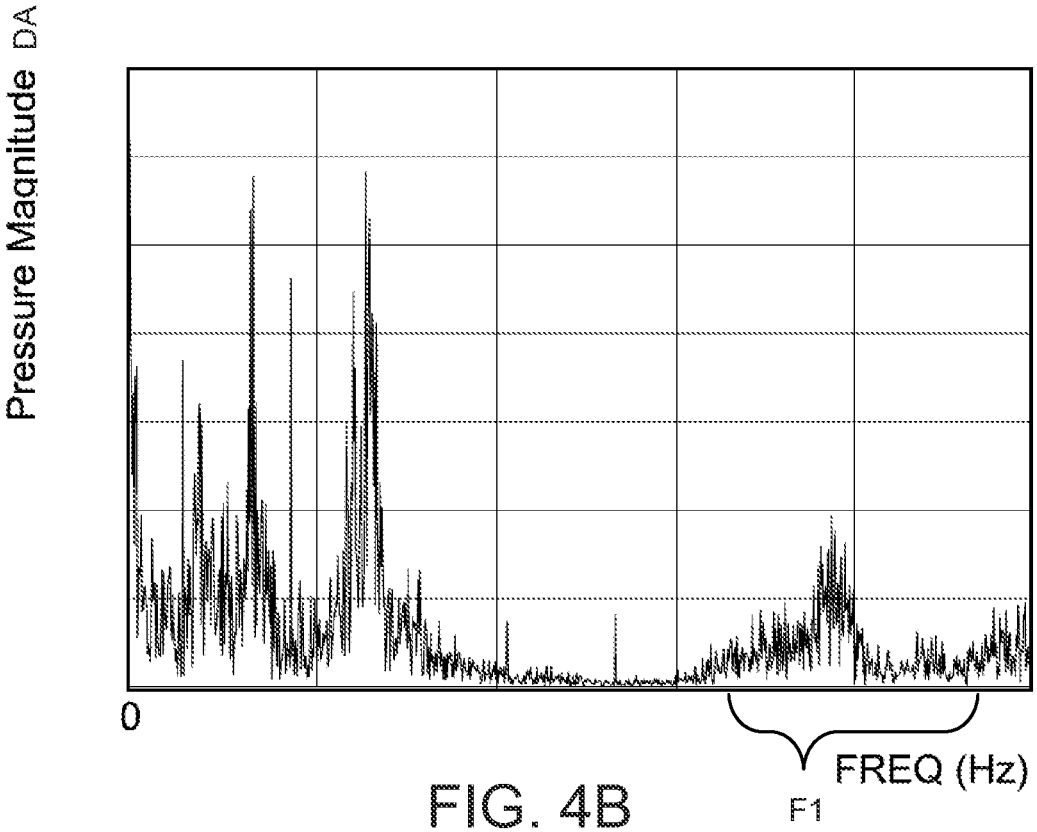
FIG. 4B illustrates an exemplary graph of dynamic pressure magnitudes over a frequency range during a flameholding event.
Figure 5A:
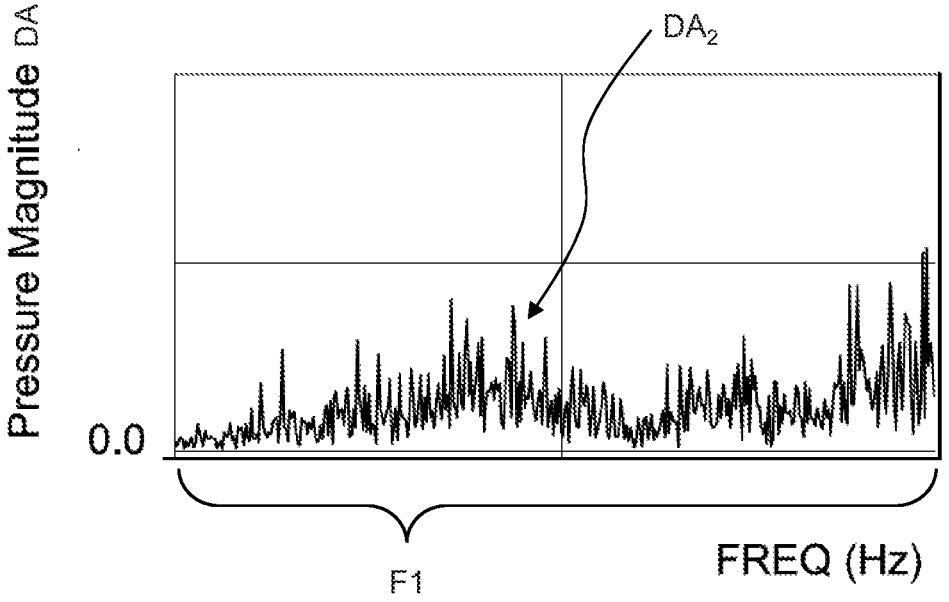
FIG. 5A illustrates an enhanced view of an exemplary graph of dynamic pressure magnitudes over a frequency range during nominal operation.
Figure 5B:
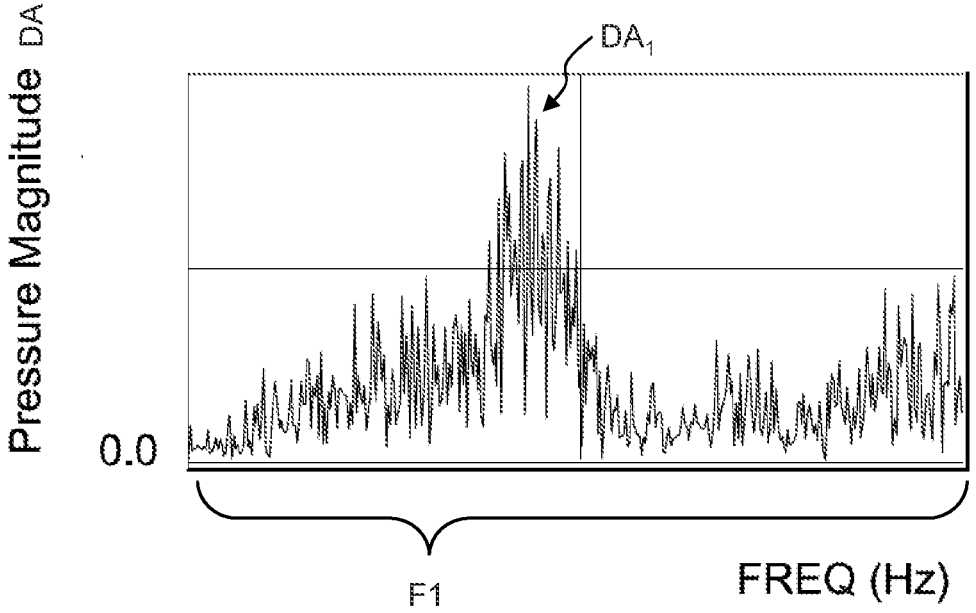
FIG. 5B illustrates an enhanced view of an exemplary graph of dynamic pressure magnitudes over a frequency range during a flameholding event.

FIGS. 4A and 4B illustrate exemplary graphs of the output data in the form of dynamic amplitudes DA over an exemplary frequency range. FIG. 4A illustrates dynamic amplitudes DA over the exemplary frequency range during normal operations of the combustor 124, which exclude the occurrence of a flameholding event. In contrast, FIG. 4B illustrates dynamic amplitudes DA over the same frequency range as is shown in FIG. 4A in which a flameholding event is occurring at a characteristic frequency sub-range F1. FIG. 5A illustrates an enlarged view of FIG. 4A in the characteristic frequency sub-range F1 (as shown in FIG. 4A), and FIG. 5B illustrates an enlarged view of FIG. 4B for the same frequency sub-range F1 (as shown in FIG. 4B). The dynamic amplitudes DA as shown in FIGS. 4A, 4B, 5A and 5B are specific to an exemplary turbine engine and are not intended to be limiting, and it is understood that other dynamic amplitudes are applicable for other turbine engines.

As shown in FIGS. 4A and 4B, the dynamic amplitudes DA exhibited by the combustor 124 under normal operating conditions (in which a flameholding event is not occurring, as in FIG. 4A) and those exhibited by the combustor 124 experiencing a flameholding event (FIG. 4B) are substantially the same except for the dynamic amplitudes DA within the characteristic frequency sub-range F1. As shown in FIGS. 5A and 5B, a flameholding occurrence is reflected in increased dynamic amplitudes DA, where peak dynamic amplitudes $DA_1$ as a result of a flameholding occurrence are measurably greater than peak dynamic amplitudes $DA_2$ of normal operating conditions (i.e., a non-flameholding occurrence). FIGS. 5A and 5B are displayed with the same scale as each other for purposes of comparison. In the exemplary graphs of FIGS. 4A, 4B, 5A and 5B, the peak dynamic amplitude $DA_1$ during a flameholding occurrence is nearly double the peak dynamic amplitude $DA_2$ during a non-flameholding occurrence. It is understood that other ratios of peak dynamic amplitude during a flameholding occurrence relative to peak dynamic amplitude during a non-flameholding occurrence can vary for other exemplary turbine engines, and such peak dynamic amplitudes may occur at different characteristic frequency sub-ranges.

The substantially greater peak dynamic amplitude during a flameholding occurrence ($DA_1$) is detectable in lab measurements and is greater than a peak dynamic amplitude produced by noise or other factors. For an exemplary turbine engine, empirical testing of the turbine engine 100 in a controlled environment can be implemented to determine the ratios of peak dynamic amplitude ($DA_1$) during a flameholding occurrence relative to peak dynamic amplitude ($DA_2$) during a non-flameholding occurrence. Thus, through empirical testing and observation of the dynamic amplitudes for the characteristic frequency sub-range F1, a dynamic amplitude threshold TL (as shown in FIG. 6) is determined, where a correlation between dynamic amplitudes over the threshold and a flameholding occurrence has been demonstrated.

Figure 6:
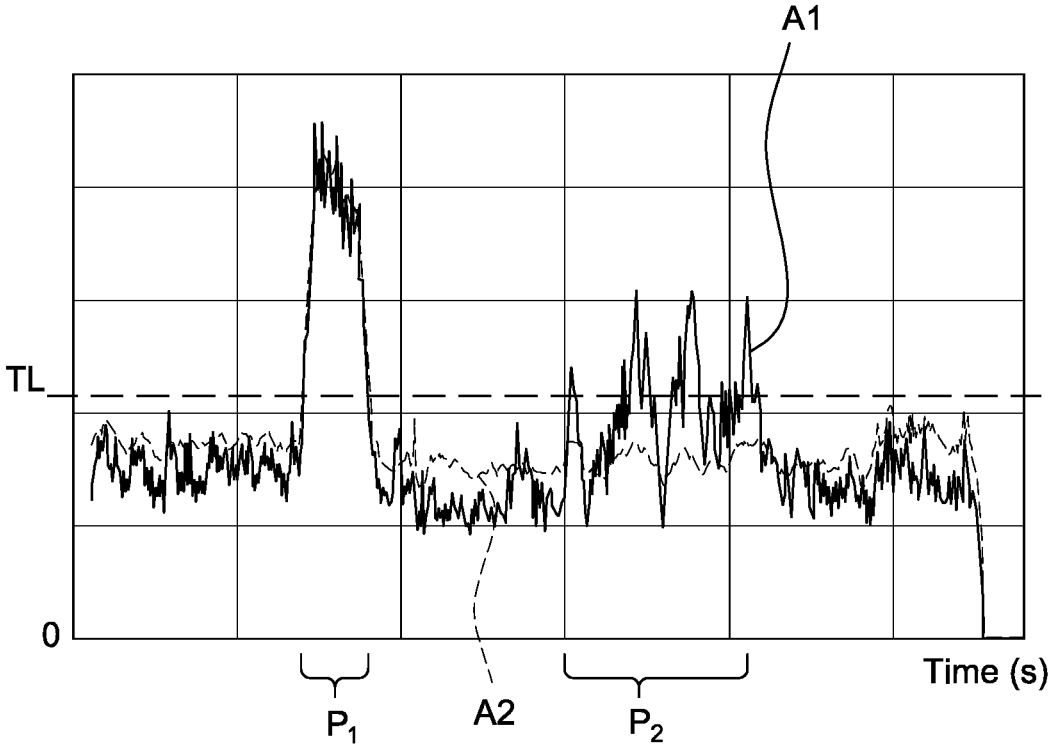
FIG. 6 illustrates an exemplary graph of dynamic amplitudes over time.

FIG. 6 illustrates an exemplary graph of the output data in the form of dynamic amplitudes DA taken over a period of time. Amplitude A1 (shown with a solid line) represents the peak hold, and amplitude A2 (shown with a dashed line) represents the spectral energy integration. As used herein, spectral energy integration is an integral function of the amplitudes over the frequency sub-range F1. Moreover, as used herein, the "peak hold" graph A1 is a secondary trace graph illustrating the highest amplitude values for each frequency of the spectral energy integration of amplitude A2.

As can be appreciated by comparing FIGS. 3 and 6, fluctuations in dynamic pressure due to a flameholding occurrence is difficult to detect in the time domain. This is due to a lack of resolution and ancillary noise present in the system. Analyzing the amplitudes A1 and A2 in the frequency domain produces frequency amplitudes or peaks that correspond to a flameholding occurrence. As illustrated in FIG. 6, a flameholding occurrence is represented at period of time $P_1$ (measured in seconds) in which amplitudes of both the spectral energy amplitude A2 and peak hold amplitude A1 exceed the dynamic amplitude threshold TL. In contrast, for the period of time P2, although the peak hold amplitude A1 exceeds the dynamic amplitude threshold TL, a flameholding event is not occurring. Measuring and detecting for amplitudes using only a peak hold method gives a false indication of flameholding. The amplitudes from the spectral energy integration method (spectral energy amplitude A2) show levels of amplitudes below the dynamic amplitude threshold TL and therefore correctly indicate that there was no flameholding event.

To determine if a flameholding event has occurred or is occurring, the amplitudes for a given dynamic amplitude DA measurement are compared against the dynamic amplitude threshold TL stored in memory (e.g., memory 204). By way of example shown in FIGS. 1 and 2, a profile for the turbine engine 100 is stored in memory, and the profile includes the dynamic amplitude threshold TL that corresponds to a flameholding occurrence of the turbine engine 100. Stated differently, when considering spectral energy amplitudes A2, an amplitude occurring below the dynamic amplitude threshold TL corresponds to a flameholding non-occurrence, and an amplitude occurring above the dynamic amplitude threshold TL corresponds to a flameholding occurrence. It should be appreciated that different turbine engines can have different profiles and different dynamic amplitude thresholds. The profile for a turbine engine can be determined empirically in a controlled or laboratory setting and can be pre-loaded to local memory 204. In embodiments where the detection system 250 is retrofitted onto existing turbine engines, the profile can be loaded to local memory 204.

The processor 202 determines that the flameholding condition is occurring by comparing the spectral energy amplitude A2 to the dynamic amplitude threshold TL of the profile for the turbine engine 100. In some embodiments, the processor 202 also compares the period of time in which the spectral energy amplitude A2 exceeds the dynamic amplitude threshold TL against a minimum period of time for a flameholding occurrence. By way of example, if a spectral energy amplitude A2 is above the dynamic amplitude threshold TL for a time less than the pre-determined minimum amount of time, the processor 202 determines that a flameholding condition is not occurring.

Thus, the processor 202, by comparing the spectral energy amplitude A2 against profiles stored in memory 204, can determine if a flameholding condition has occurred or is occurring. The processor 202 can transmit a signal through the communications interface 206 to the network 210 to alert a user that a flameholding event is occurring or has occurred. In some embodiments, the processor 202 can store the date and time of the flameholding occurrence in memory 204.

In some embodiments, the processor 202 is programmed to perform the transformation every 4 Hz. Thus, once the period of time P is elapsed, the processor 202 can mitigate the flameholding conditions in real-time. In some embodiments, the processor 202 is programmed to perform a check (as described in more detail below with respect to method 300 shown in FIG. 4) every ten seconds. In some embodiments, the processor 202 is configured to perform a check every two seconds.

In some embodiments, the detection system 250 and, more particularly, the processor 202 can mitigate flameholding conditions in real time and thus stop the flameholding from occurring. If the processor 202 has detected that a flameholding condition is occurring, the processor 202 can instruct the communications interface 206 to decrease the hydrogen gas concentrations of the fuel mixture (e.g., from the second hydrogen gas concentration to the first hydrogen gas concentration, or to any desired value in-between the first and second concentrations), until the flameholding occurrence has ceased. In some embodiments, the communications interface 206 is coupled to mixing valve 172 and the plurality of blended fuel valves 152 (one of which is shown in FIG. 1). As a result of the quick detection and mitigation capabilities of the present detection system 250, the turbine engine 100 can safely and continuously operate within the broadened flameholding margin window using the second hydrogen gas concentration and with increased efficiency and reduced emissions and reduced audible noise, without the risk of a flameholding event stalling or damaging the turbine engine 100.

FIG. 7 illustrates a flowchart of an exemplary method 300 for use in detecting and mitigating flameholding in a turbine engine 100. With reference to components illustrated in FIGS. 1 through 6, in the exemplary embodiment, the method 300 includes positioning 302 at least one dynamic pressure sensor 208 within at least one combustor 124 of the turbine engine 100, wherein the at least one dynamic pressure sensor 208 is communicatively coupled to the processor 202. The method 300 further includes measuring 304, by the at least one dynamic pressure sensor 208, dynamic pressure data DP and, in some embodiments, storing the dynamic pressure data DP in local memory 204. The method 300 further includes converting 306, by the processor 202, the dynamic pressure data DP in the time domain through mathematical integration to obtain frequency-domain spectral energy amplitudes A2 in the frequency domain for the dynamic pressure data. The method 300 further includes comparing 308, by the processor 202, the frequency-domain spectral energy amplitudes against a profile stored in local memory 204 to determine if the frequency-domain spectral energy amplitudes exceed a predetermined dynamic amplitude threshold value TL of the profile, where exceeding the dynamic amplitude threshold TL indicates a flameholding occurrence. The method 300 further includes mitigating 310 flameholding conditions of the turbine engine 100. In some embodiments, mitigating flameholding conditions includes decreasing 312, by the processor 202, hydrogen gas concentrations of the fuel mixture from the second hydrogen gas concentration to the first hydrogen gas concentration or to a desired value between the first and second hydrogen gas concentrations, until the flameholding occurrence has ceased. To mitigate the flameholding occurrence, processor 202 can transmit a signal to blending valve 172 to adjust the hydrogen gas concentration supplied to the blended fuel supply 150 and/or can transmit a signal to one or more the plurality of blended fuel valves 152 coupled to each combustor 124 to redistribute the blended fuel among the fuel injectors 126 of the combustor 124.

FIG. 8 illustrates a flowchart of an exemplary method 400 for operating a turbine engine at reduced emissions and reduced audible noise. With reference to FIGS. 1 through 6, the exemplary method 400 includes supplying a fuel mixture having a second hydrogen gas concentration to at least one combustor 124 of the turbine engine 100. The method 400 further includes measuring 404, via at least one dynamic pressure sensor 208 within the at least one combustor 124, dynamic pressure data DP within a turbine engine combustor and, in some embodiments, storing the dynamic pressure data DP in local memory 204. The at least one dynamic pressure sensor 208 is communicatively coupled to the processor 202. The method 400 further includes converting 406, by the processor 202, the dynamic pressure data DP in the time domain through mathematical integration to obtain frequency-domain spectral energy amplitudes in the frequency domain for the dynamic pressure data. The method 400 further includes comparing 408, by the processor 202, the frequency-domain spectral energy amplitudes A2 against a profile stored in local memory 204 to determine if the frequency-domain spectral energy amplitudes A2 exceed a predetermined dynamic amplitude threshold value TL of the profile, where exceeding the dynamic amplitude threshold TL indicates a flameholding occurrence. The method 400 further includes mitigating 410 flameholding conditions of the turbine engine 100. In some embodiments, mitigating flameholding conditions includes decreasing 412, by the processor 202, hydrogen gas concentrations of the fuel mixture from the second hydrogen gas concentration to the first hydrogen gas concentration or to a desired value between the first and second hydrogen gas concentrations, until the flameholding occurrence has ceased. To mitigate the flameholding occurrence, processor 202 can transmit a signal to blending valve 172 to adjust the hydrogen gas concentration in the fuel mixture supplied to the blended fuel supply 150 and/or can transmit a signal to one or more the plurality of blended fuel valves 152 coupled to each combustor 124 to redistribute the blended fuel among the fuel injectors 126 of the combustor 124.

In some embodiments, the method 400 also includes increasing 414, by the processor 202, hydrogen gas concentrations of the fuel mixture from the first hydrogen gas concentration to the second hydrogen gas concentration when the flameholding conditions are mitigated, such that the turbine engine 100 returns to operation within the broadened flameholding margin window and with the reduced emissions and reduced audible noise. To return to operation within the broadened flameholding margin window, processor 202 can transmit a signal to blending valve 172 to increase the hydrogen gas concentration in the fuel mixture supplied to the blended fuel supply 150.

The computer systems discussed herein may include additional, less, or alternate functionality, including that discussed elsewhere herein. The computer systems discussed herein may include or be implemented via computer-executable instructions stored on non-transitory computer-readable media or medium.

Exemplary embodiments of methods for detecting, controlling and mitigating flameholding occurrences are described above in detail. The methods are not limited to use with the specific turbine embodiments described herein, but rather, the methods can be utilized independently and separately from other components described herein. For example, the methods may be used with any utility, industrial, or mechanical drive turbine. Moreover, the disclosure is not limited to the embodiments of the method described above in detail. Rather, other variations of the method may be utilized within the spirit and scope of the claims.

In each embodiment, the above-described methods and systems of detecting and mitigating flameholding conditions enable turbine engines to operate with higher hydrogen concentration while preventing engine flameholding from occurring. Moreover, the methods and systems can determine, in real time and during continuous operation of the turbine engine, flameholding conditions of turbine engines while operating at higher hydrogen concentration. The methods and systems can be applied to existing turbine engines in the field by programming a profile, which contains threshold limits and the described instructions to a processor of an existing turbine engine to enable the existing turbine engine to detect and mitigate flameholding. More specifically, the processor can be programmed to check (described in method 300 in FIG. 7) for a flameholding event without additional components or modification to the turbine engine.

Any logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

It will be appreciated that the above embodiments that have been described in particular detail are merely example or possible embodiments, and that there are many other combinations, additions, or alternatives that may be included.

Also, the particular naming of the components, capitalization of terms, the attributes, data structures, or any other programming or structural aspect is not mandatory or significant, and the mechanisms that implement the disclosure or its features may have different names, formats, or protocols. Further, the system may be implemented via a combination of hardware and software, as described, or entirely in hardware elements. Also, the particular division of functionality between the various system components described herein is merely one example and is not mandatory. Rather, functions performed by a single system component may instead be performed by multiple components, and functions performed by multiple components may instead performed by a single component.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, where range limitations may be combined and/or interchanged, such ranges are identified and include all the sub-ranges contained therein unless context or language indicates otherwise.

Various changes, modifications, and alterations in the teachings of the present disclosure may be contemplated by those skilled in the art without departing from the intended spirit and scope thereof. It is intended that the present disclosure encompass such changes and modifications.

This written description uses examples to describe the disclosure, including the best mode, and also to enable any person skilled in the art to practice the disclosure, including making and using any devices or systems and performing any incorporated methods. The patentable scope of the disclosure is defined by the claims and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the present system and methods have been described in terms of various specific embodiments, those skilled in the art will recognize that the subject technology can be practiced with modification within the spirit and scope of the claims. The present system and method may be defined by the following exemplary clauses:

According to a first aspect, a method for detecting flameholding in at least one combustor of a turbine engine comprises: measuring dynamic pressure within the at least one combustor of the turbine engine; converting dynamic pressure data to frequency-domain spectral energy amplitudes associated with the dynamic pressure data; and comparing the frequency-domain spectral energy amplitudes against a dynamic amplitude threshold value to determine whether the spectral energy amplitudes exceed the dynamic amplitude threshold value, wherein those spectral energy amplitudes exceeding the dynamic amplitude threshold value indicate a flameholding occurrence.

According to the previous aspect, the method further comprises mitigating flameholding conditions of the at least one combustor when a flameholding occurrence is determined.

According to any of the previous aspects, mitigating flameholding conditions of the at least one combustor includes adjusting hydrogen gas concentrations of a fuel mixture supplied by a fuel injection system to the at least one combustor from a second hydrogen gas concentration to a first hydrogen gas concentration, wherein the second hydrogen gas concentration is greater than the first hydrogen gas concentration.

According to any of the previous aspects, a standard operating window of the turbine engine is defined by supplying the at least one combustor with the fuel mixture having the first hydrogen gas concentration, and a broadened flameholding margin window of the turbine engine is defined by supplying the at least one combustor with the fuel mixture having the second hydrogen gas concentration.

According to any of the previous aspects, a processor is programmed to cause a mixing valve coupled to a hydrogen fuel supply and a natural gas fuel supply to selectively change the hydrogen gas concentrations of the fuel mixture, wherein a blended fuel supply downstream of the mixing valve supplies the fuel mixture to fuel injectors of the at least one combustor of the turbine engine.

According to any of the previous aspects, mitigating flameholding conditions of the at least one combustor includes decreasing at least one of a fuel injector pressure ratio, a velocity of the fuel mixture, and a temperature of the fuel mixture supplied to the at least one combustor.

According to any previous aspects, the method further comprises positioning at least one dynamic pressure sensor within the at least one combustor to measure dynamic pressure within the respective combustor, wherein the at least one dynamic pressure sensor is coupled to a processor.

According to any previous aspects, the method further comprises storing the dynamic pressure data in local memory, wherein the local memory is coupled to the processor.

According to any previous aspect, the dynamic pressure data is converted to the frequency-domain spectral energy amplitudes by performing mathematical integration of the dynamic pressure data.

According to any previous aspect, the mathematical integration is selected from the group consisting of Fourier Transforms, fast Fourier transforms, discrete Fourier transforms, and numeric computing.

According to any previous aspect, the dynamic amplitude threshold value is stored in local memory, the local memory connected to a processor.

According to any previous aspect, the dynamic amplitude threshold value corresponds to a flameholding occurrence of the turbine engine.

According to any previous aspect, the dynamic pressure data is in the time-domain, and the spectral energy amplitudes is in the frequency domain.

According to a second aspect of the present disclosure, a method of operating a turbine engine at reduced emissions and reduced audible noise comprises: supplying a fuel mixture having a second hydrogen gas concentration to at least one combustor of the turbine engine, wherein the second hydrogen gas concentration defines a broadened flameholding margin window of the turbine engine, the broadened flameholding margin window resulting in the reduced emissions and reduced audible noise of the turbine engine; measuring dynamic pressure data within at least one combustor of the turbine engine; converting the dynamic pressure data to frequency-domain spectral energy amplitudes associated with the dynamic pressure data; comparing the spectral energy amplitudes against a dynamic amplitude threshold value to determine whether the spectral energy amplitudes exceed the dynamic amplitude threshold value, wherein the spectral energy amplitudes exceeding the dynamic amplitude threshold value indicate a flameholding occurrence; and mitigating flameholding conditions of the at least one combustor by adjusting the hydrogen gas concentration of the fuel mixture supplied to the at least one combustor from the second hydrogen gas concentration to a first hydrogen gas concentration, wherein the second hydrogen gas concentration is higher than the first hydrogen gas concentration, wherein the first hydrogen gas concentration defines a standard operating window.

According to the second aspect, mitigating flameholding conditions of the at least one combustor includes decreasing at least one of a fuel injector pressure ratio, a velocity of the fuel mixture, and a temperature of the fuel mixture supplied to the turbine engine.

According to the second aspect and any intervening aspects, the method comprises increasing the hydrogen gas concentration of the fuel mixture from the first hydrogen gas concentration to the second hydrogen gas concentration after the flameholding conditions are mitigated.

According to a third aspect of the present disclosure, a system to facilitate operating at least one combustor of a turbine engine within flameholding margins is provided, the system comprising: a fuel injection system coupled in flow communication with a blended fuel supply for supplying a fuel mixture into at least one fuel injector within the at least one combustor of the turbine engine, the fuel mixture having a hydrogen gas concentration adjustable from a first hydrogen gas concentration to a second hydrogen gas concentration, the second hydrogen gas concentration being higher than the first hydrogen gas concentration; and a detection system including a processor and a plurality of dynamic pressure sensors, the processor programmed to: supply the fuel mixture with the second hydrogen gas concentration to the turbine engine, wherein the second hydrogen gas concentration defines a broadened flameholding margin window of the turbine engine, wherein the broadened flameholding margin window enables the turbine engine to operate at higher mechanical power output, reduced emissions, and reduced audible noise relative to the turbine engine operating at the first hydrogen gas concentration; receive, from one or more of the plurality of dynamic pressure sensors, dynamic pressure data measured within the at least one combustor of the turbine engine; convert the dynamic pressure data to frequency-domain spectral energy amplitudes associated with the dynamic pressure data; compare the spectral energy amplitudes against a dynamic amplitude threshold to determine whether the spectral energy amplitudes exceed the dynamic amplitude threshold, wherein spectral energy amplitudes exceeding the dynamic amplitude threshold indicate a flameholding occurrence; and decrease the hydrogen gas concentration of the fuel mixture from the second hydrogen gas concentration to the first hydrogen gas concentration, wherein the first hydrogen gas concentration defines a standard operating window that has a reduced likelihood of flameholding as compared to the broadened flameholding margin window.

According to the third aspect, the processor is further programmed to control a mixing valve coupled to a hydrogen gas supply and a natural gas supply to selectively change the hydrogen gas concentrations of the fuel mixture, wherein the mixing valve is upstream of a blended fuel supply that supplies operating fuel to the fuel injectors of the at least one combustor of the turbine engine.

According to the third aspect and any intervening aspects, the processor is further programmed to mitigate flameholding conditions of the at least one combustor by one or more of adjusting the hydrogen gas concentration supplied to the blended fuel supply, redistributing the blended fuel among fuel injectors of the one or more combustors, and decreasing at least one of a fuel injector pressure ratio, a velocity of the fuel mixture, and a temperature of the fuel mixture supplied to the at least one combustor.

According to the third aspect and any intervening aspects, the dynamic pressure data is converted to frequency-domain amplitudes by performing mathematical integration of the dynamic pressure data.

What is claimed is:

1. A method for detecting flameholding in at least one combustor of a turbine engine comprising:

measuring, by a sensor, dynamic pressure within the at least one combustor of the turbine engine;

converting, by a processor, dynamic pressure data to frequency-domain spectral energy amplitudes associated with the dynamic pressure data;

comparing the frequency-domain spectral energy amplitudes against a dynamic amplitude threshold value, stored in a local memory, to determine whether the spectral energy amplitudes exceed the dynamic amplitude threshold value, wherein those spectral energy amplitudes exceeding the dynamic amplitude threshold value indicate a flameholding occurrence; and changing at least one operating parameter of the at least one combustor based on the determination of a flameholding occurrence.

2. The method of claim 1, further comprising mitigating flameholding conditions of the at least one combustor when a flameholding occurrence is determined.

3. The method of claim 2, wherein mitigating flameholding conditions of the at least one combustor includes adjusting hydrogen gas concentrations of a fuel mixture supplied by a fuel injection system to the at least one combustor from a second hydrogen gas concentration to a first hydrogen gas concentration, wherein the second hydrogen gas concentration is greater than the first hydrogen gas concentration.

4. The method of claim 3, wherein a standard operating window of the turbine engine is defined by supplying the at least one combustor with the fuel mixture having the first hydrogen gas concentration, and a broadened flameholding margin window of the turbine engine is defined by supplying the at least one combustor with the fuel mixture having the second hydrogen gas concentration.

5. The method of claim 3, wherein the processor is programmed to cause a mixing valve coupled to a hydrogen fuel supply and a natural gas fuel supply to selectively change the hydrogen gas concentrations of the fuel mixture, wherein a blended fuel supply downstream of the mixing valve supplies the fuel mixture to fuel injectors of the at least one combustor of the turbine engine.

6. The method of claim 3, wherein mitigating flameholding conditions of the at least one combustor includes decreasing at least one of a fuel injector pressure ratio, a velocity of the fuel mixture, and a temperature of the fuel mixture supplied to the at least one combustor.

7. The method of claim 1, wherein the sensor is at least one dynamic pressure sensor positioned within the at least one combustor to measure dynamic pressure within the respective combustor, wherein the at least one dynamic pressure sensor is coupled to the processor.

8. The method of claim 7, further comprising storing the dynamic pressure data in the local memory, wherein the local memory is coupled to the processor.

9. The method of claim 1, wherein the dynamic pressure data is converted to the frequency-domain spectral energy amplitudes by performing mathematical integration of the dynamic pressure data.

10. The method of claim 9, wherein the mathematical integration is selected from the group consisting of Fourier Transforms, fast Fourier transforms, discrete Fourier transforms, and numeric computing.

11. The method of claim 1, wherein the local memory is connected to the processor.

12. The method of claim 11, wherein the sensor continuously monitors the dynamic pressure data and transmits the dynamic pressure data to the processor.

13. The method of claim 1, wherein the dynamic pressure data is in the time-domain, and the spectral energy amplitudes a in the frequency domain.

14. A method of operating a turbine engine at reduced emissions and reduced audible noise, the method comprising:

supplying a fuel mixture having a second hydrogen gas concentration to at least one combustor of the turbine engine, wherein the second hydrogen gas concentration defines a broadened flameholding margin window of the turbine engine, the broadened flameholding margin window resulting in the reduced emissions and reduced audible noise of the turbine engine;

measuring, via a sensor, dynamic pressure data within at least one combustor of the turbine engine;

converting, via a processor, the dynamic pressure data to frequency-domain spectral energy amplitudes associated with the dynamic pressure data;

comparing the spectral energy amplitudes against a dynamic amplitude threshold value stored in a memory to determine whether the spectral energy amplitudes exceed the dynamic amplitude threshold value, wherein the spectral energy amplitudes exceeding the dynamic amplitude threshold value indicate a flameholding occurrence; and mitigating flameholding conditions of the at least one combustor by adjusting the hydrogen gas concentration of the fuel mixture supplied to the at least one combustor from the second hydrogen gas concentration to a first hydrogen gas concentration, wherein the second hydrogen gas concentration is higher than the first hydrogen gas concentration, wherein the first hydrogen gas concentration defines a standard operating window.

15. The method of claim 14, wherein mitigating flameholding conditions of the at least one combustor includes decreasing at least one of a fuel injector pressure ratio, a velocity of the fuel mixture, and a temperature of the fuel mixture supplied to the turbine engine.

16. The method of claim 14, further comprising increasing the hydrogen gas concentration of the fuel mixture from the first hydrogen gas concentration to the second hydrogen gas concentration after the flameholding conditions are mitigated.

17. A system to facilitate operating at least one combustor of a turbine engine within flameholding margins, the system comprising:

a fuel injection system coupled in flow communication with a blended fuel supply for supplying a fuel mixture into at least one fuel injector within the at least one combustor of the turbine engine, the fuel mixture having a hydrogen gas concentration adjustable from a first hydrogen gas concentration to a second hydrogen gas concentration, the second hydrogen gas concentration being higher than the first hydrogen gas concentration; and a detection system including a processor and a plurality of dynamic pressure sensors, the processor programmed to:

supply the fuel mixture with the second hydrogen gas concentration to the turbine engine, wherein the second hydrogen gas concentration defines a broadened flameholding margin window of the turbine engine, wherein the broadened flameholding margin window enables the turbine engine to operate at higher mechanical power output, reduced emissions, and reduced audible noise relative to the turbine engine operating at the first hydrogen gas concentration;

receive, from one or more of the plurality of dynamic pressure sensors, dynamic pressure data measured within the at least one combustor of the turbine engine;

convert the dynamic pressure data to frequency-domain spectral energy amplitudes associated with the dynamic pressure data;

compare the spectral energy amplitudes against a dynamic amplitude threshold to determine whether the spectral energy amplitudes exceed the dynamic amplitude threshold, wherein spectral energy amplitudes exceeding the dynamic amplitude threshold indicate a flameholding occurrence; and decrease the hydrogen gas concentration of the fuel mixture from the second hydrogen gas concentration to the first hydrogen gas concentration, wherein the first hydrogen gas concentration defines a standard operating window that has a reduced likelihood of flameholding as compared to the broadened flameholding margin window.

18. The system of claim 17, wherein the processor is further programmed to control a mixing valve coupled to a hydrogen gas supply and a natural gas supply to selectively change the hydrogen gas concentrations of the fuel mixture, wherein the mixing valve is upstream of a blended fuel supply that supplies operating fuel to the fuel injectors of the at least one combustor of the turbine engine.

19. The system of claim 17, wherein the processor is further programmed to mitigate flameholding conditions of the at least one combustor by one or more of adjusting the hydrogen gas concentration supplied to the blended fuel supply, redistributing the blended fuel among fuel injectors of the one or more combustors, and decreasing at least one of a fuel injector pressure ratio, a velocity of the fuel mixture, and a temperature of the fuel mixture supplied to the at least one combustor.

20. The system of claim 17, wherein the dynamic pressure data is converted to frequency-domain amplitudes by performing mathematical integration of the dynamic pressure data.

* * * * *